US011351585B2

(12) United States Patent
Zhou et al.

(10) Patent No.: US 11,351,585 B2
(45) Date of Patent: Jun. 7, 2022

(54) PREPARATION METHOD FOR A HIGH-STRENGTH EXTRUDED PROFILE OF MG—ZN—SN—MN ALLOY

(71) Applicants: QILU UNIVERSITY OF TECHNOLOGY, Jinan (CN); ADVANCED MATERIALS INSTITUTE, SHANDONG ACADEMY OF SCIENCES, Shandong (CN)

(72) Inventors: Jixue Zhou, Jinan (CN); Yunteng Liu, Jinan (CN); Dongqing Zhao, Jinan (CN); Baichang Ma, Jinan (CN); Meifang Wang, Jinan (CN); Peiliang Li, Jinan (CN); Cong Liu, Jinan (CN); Shouqiu Tang, Jinan (CN)

(73) Assignees: QILU UNIVERSITY OF TECHNOLOGY, Shandong Province (CN); ADVANCED MATERIALS INSTITUTE, SHANDONG ACADEMY OF SCIENCES, Shandong (CN)

( * ) Notice: Subject to any disclaimer, the term of this patent is extended or adjusted under 35 U.S.C. 154(b) by 93 days.

(21) Appl. No.: 16/798,851

(22) Filed: Feb. 24, 2020

(65) Prior Publication Data

US 2020/0269298 A1 Aug. 27, 2020

(30) Foreign Application Priority Data

Feb. 22, 2019 (CN) ..... 201910140422.1

(51) Int. Cl.

| | |
|---|---|
| ***B21C 23/00*** | (2006.01) |
| ***B21C 23/14*** | (2006.01) |
| ***C22C 23/04*** | (2006.01) |
| ***C22F 1/06*** | (2006.01) |

(52) U.S. Cl.

CPC ..... *B21C 23/002* (2013.01); *B21C 23/142* (2013.01); *C22C 23/04* (2013.01); *C22F 1/06* (2013.01)

(58) Field of Classification Search

None

See application file for complete search history.

(56) References Cited

U.S. PATENT DOCUMENTS

2016/0168678 A1* 6/2016 Li ..... C22C 23/06 148/557

FOREIGN PATENT DOCUMENTS

CN 102230118 A 11/2011

OTHER PUBLICATIONS

Aug. 29, 2019 Office Action issued in Chinese Patent Application No. 201910140422.1.

Sep. 23, 2019 Office Action issued in Chinese Patent Application No. 201910140422.1.

Baichang Ma. "Study on Microstructure and Mechanical Properties of High Performance Mg—Zn—Sn—Mn—Extruded Magnesium Alloy". Aug. 15, 2016.

* cited by examiner

*Primary Examiner* — Brian D Walck

(74) *Attorney, Agent, or Firm* — Oliff PLC

(57) ABSTRACT

A method for preparing a high-strength extruded profile of an Mg—Zn—Sn—Mn alloy is composed of a solid solution treatment at two stages to a billet, a high-temperature pre-aging to the billet, a low-temperature rapid extrusion and a low-temperature aging treatment to a profile. The Mg—Zn—Sn—Mn alloy includes the following elements in mass percent: 5.8-6.2% of Zn, 3.0-3.5% of Sn, 0.25-0.45% of Mn, unavoidable impurities of 0.05% or less, and the balance magnesium. The Mg—Zn—Sn—Mn magnesium alloy profile has a fine grain size of about 10-20 μm and a dispersed second phase, so a high strength and a good elongation can be obtained therein, and a tensile strength of 350 MPa or more, a yield strength of 280 MPa or more, and the elongation of 12% or more. In addition, the profile has a high extrusion production efficiency and a high yield, and a low extrusion cost.

4 Claims, No Drawings

PREPARATION METHOD FOR A HIGH-STRENGTH EXTRUDED PROFILE OF MG—ZN—SN—MN ALLOY

FIELD OF THE INVENTION

The present invention pertains to a technical field of metallic material, and particularly relates to a heat treatment and extrusion method for a high-strength extruded profile of an Mg—Zn—Sn—Mn alloy.

BACKGROUND OF THE INVENTION

Magnesium alloy has such characteristics as a low density, a high specific strength and a specific stiffness, a good damping performance and an easy machinability, which make it to have broad application prospects in transportation, electronics industry, military industry and other fields. In addition, such civil fields as electric vehicle and rail transit have also become one of the key development directions for the future development of deformed magnesium alloys.

However, a problem currently restricting the development of magnesium alloys is that the mechanical performances of commercial AZ-based magnesium alloys cannot meet the higher requirements in the transportation field, and the high cost of ZK-based magnesium alloys and rare-earth-containing magnesium alloys has hindered their large-scale applications in the civilian field.

The invention patent "A magnesium alloy with high strength and high yield ratio and its preparation method" (Patent number: CN201110186910.X) proposes a Mg—Zn—Sn—Mn alloy which is produced at a low cost to have a high strength and can be extruded at low temperature, thus have good application prospects. However, the profiles obtained by a conventional heat treatment process and a extrusion through the split assembly mold have a poor mechanical performance, and cannot meet the requirements of industrial applications.

A paper titled "Effect of pre-aging process on microstructure and performance of AZ80 magnesium alloy followed by thermomechanical treatment" is directed to a process path of the solid solution treatment+pre-aging+deformation+aging treatment for AZ80 magnesium alloy, and focused on the impact of the pre-aging and subsequent deformation on performance the AZ80 magnesium alloy. The experimental results show that the majority of $Mg_{17}Al_{12}$ phases are dissolved in the α-Mg matrix by the solid solution treatment. After the deformation treatment, the crystal grains are elongated, a second phase or impurities are distributed along the deformation direction, and an obvious elongated grain structure appears, and a large number of staggered deformation twins appear inside the crystal grains. The greater the degree of deformation, the more pronounced the work hardening effect. At 30%, the hardness increases slowly. The pre-aging before the deformation increases the nucleation for recrystallization. During the aging treatment after the deformation, a recrystallization occurs, the elongated grain structure generated by the deformation disappears, and equiaxed grains are generated. The greater the degree of deformation, the finer the equiaxed grains after recrystallization. The combined effect of recrystallization softening and aging precipitation strengthening makes the hardness of AZ80 magnesium alloy slightly higher than that before the aging. In summary, the deformation heat treatment can effectively improve the microstructure and mechanical performances of AZ80 magnesium alloy.

Therefore, it is of great significance to develop a new heat treatment and extrusion process, in order to improve the mechanical performances of Mg—Zn—Sn—Mn alloy profiles with a low cost and high strength, and further enlarge the application range of magnesium alloys.

SUMMARY OF THE INVENTION

With respect to a problem that the existing Mg—Zn—Sn—Mn alloy extruded profile has a coarse grain size, which in turn causes the material to have poor mechanical performances, the invention provides a heat treatment extrusion method. The Mg—Zn—Sn—Mn magnesium alloy profile prepared by this method has a fine grain size and a dispersed second phase, so a high strength and a good elongation can be obtained therein.

To achieve the above technical objectives, the following technical solid solutions are adopted by the present invention.

A preparation method of a high-strength extruded profile of Mg—Zn—Sn—Mn alloy comprises: a solid solution treatment at two stages to a billet, a high-temperature pre-aging to the billet, a low-temperature rapid extrusion and a low-temperature aging treatment to a profile;

wherein, the solid solution treatment at two stages has a solid solution temperature of 330-350° C. and 400-420° C., respectively; the high-temperature pre-aging has a temperature of 320-340° C.; the low-temperature rapid extrusion treatment has a mold temperature and a extrusion cylinder temperature both of 320-340° C.

The solid solution treatment at two stages process of the present application not only completely dissolves Zn and Sn elements into a Mg matrix, but also retains a single uniform supersaturated α-magnesium solid solution containing Zn and Sn after water quenching; further together with the high-temperature pre-aging, the prepared extruded billet is allowed not to contain a low melting point phase, which makes it capable of being processed by the low-temperature rapid extrusion process in subsequent processing, so that the strength and elongation of the magnesium alloy are improved.

In some embodiments, the solid solution treatment at two stages comprises: a low-temperature solid solution, a high-temperature solid solution and a cooling.

In order to ensure that the Mg—Zn—Sn—Mn alloy has better strength and elongation after the solid solution treatment at two stages, in some embodiments, the conditions of the solid solution treatment at two stages are optimized, and it is shown that when the low-temperature solid solution has a temperature of 330 to 350° C., and a low-temperature solid solution heat preservation duration of 2 to 4 hours; the high-temperature solid solution temperature has a temperature of 400-420° C., and a high-temperature solid solution heat preservation duration of 8-10 hours; and the temperature is increased at a rate of 0.8-2° C./min, the precipitated phase is evenly distributed in the sample, has a smaller size, and is in a dispersed distribution state, which effectively improves the comprehensive mechanical performances of the sample.

The application found through study that: the Mg—Zn—Sn—Mn alloy, after the solid solution treatment at two stages, is further subjected to the high-temperature pre-aging treatment, so that some of the Sn elements in the α-magnesium solid solution can be precipitated to form a $Mg_2Sn$ phase having a higher melting point, while avoid MgZn phase having a lower melting point to precipitate prematurely. In order to ensure that the above-mentioned effects are obtained, in some embodiments of the present application, the high-temperature pre-aging treatment to the billet is performed at preferable conditions of: the aging temperature being 320-340° C., and the aging heat preservation duration being 1-3 hours; and the temperature being increased at a rate of 0.8-2° C./min. Upon the above-mentioned treatment, on one hand, it is possible to promote more dynamic recrystallization nucleation around the high melting point phase ($Mg_2Sn$) in the extrusion process through particles promotion nucleation mechanism, and to suppress excessive growth of recrystallized grains through the high temperature phase; on the other hand, defects such as cracks caused by melting of the low-melting phase (Mg Zn) during extrusion can be avoided.

In some embodiments, the magnesium alloy is extruded into a profile using a split assembly mold during the low temperature rapid extrusion. In some embodiments, in the low-temperature rapid extrusion process, the preheating temperature of the billet is 10 to 20° C. lower than the high-temperature pre-aging temperature, and is 300 to 330° C., the heat preservation duration is 0.5 to 1 hour, and the temperature is increased at a rate of 0.8 to 2° C./min; the temperature of the mold is equal to that of the extrusion cylinder and is 320-340° C.; the extrusion ratio is 10-40, and the extrusion speed is 1-5 mm/min.

In some embodiments, the low temperature aging is performed at conditions of: the aging temperature being 150-160° C., the heat preservation duration being 16-64 hours, and the temperature being increased at a rate of 0.8-2° C./min.

In some embodiments, the Mg—Zn—Sn—Mn alloy consists of the following elements in mass percent: 5.8-6.2% of Zn, 3.0-3.5% of Sn, 0.25-0.45% of Mn, unavoidable impurities of 0.05% or less, and the balance magnesium.

The invention also provides a Mg—Zn—Sn—Mn alloy prepared by any of the above methods.

The invention also provides a use of the above Mg—Zn—Sn—Mn alloy in electric vehicle, rail transit or biomedical materials.

The present invention has beneficial effects of:

(1) The solid solution treatment at two stages process can cause the Zn and Sn elements completely dissolved into a Mg matrix, and at the same duration, avoid the coarsening of the grain size of the magnesium alloy extruded billet which is easily caused by a single high temperature and long-term solid solution, and Ingot cracking caused by MgZn phase melting and other problems; in addition, the water quenching after the solid solution can retain a single uniform supersaturated α-magnesium solid solution containing Zn and Sn, which lays a foundation for the implementation of subsequent processes.

(2) After the solid solution treatment at two stages, the Mg—Zn—Sn—Mn alloy is further subjected to a high-temperature pre-aging treatment, so that some of the Sn elements in the α-magnesium solid solution can be precipitated to form a $Mg_2Sn$ phase having a higher melting point, while avoid MgZn phase having a lower melting point to precipitate prematurely. On one hand, it is possible to promote more dynamic recrystallization nucleation around the high melting point phase ($Mg_2Sn$) in the extrusion process through particles promotion nucleation mechanism, and to suppress excessive growth of recrystallized grains through the high temperature phase; on the other hand, defects such as cracks caused by melting of the low-melting phase (MgZn) during extrusion can be avoided.

(3) Because the extruded billet prepared by the aforementioned heat treatment method does not contain a low melting point phase, we can process it by using a low temperature rapid extrusion process. This produces two beneficial effects of: 1) greatly improving the production efficiency of the profile; 2) the grains in the microstructure of the profile obtained by low temperature extrusion have a fine size, and according to the Hall-Petch relationship, the strength and elongation of the profile are improved.

(4) The low-temperature aging process is used to precipitate Zn and residual Sn elements in the α-magnesium solid solution to form a uniform, fine, and dispersed MgZn phase inside the grains and on the grain boundaries, further improving the strength of the profile.

(5) The Mg—Zn—Sn—Mn alloy selected by the present invention contains appropriate amounts of Zn and Sn elements, which can ensure that the above process can maximize the solid solution and aging strengthening effects of the both elements.

In summary, the Mg—Zn—Sn—Mn magnesium alloy profile prepared by the method of the present invention has a fine grain size of about 10-20 μm and a dispersed second phase, so it has good strength and elongation; in addition, the profile has a high extrusion production efficiency and a high yield, and a low extrusion cost, thus has good application and promotion prospects.

DETAILED DESCRIPTION OF THE EMBODIMENTS

It should be noted that the following detailed descriptions are all exemplary and are intended to provide further explanation of the present application. Unless defined otherwise, all technical and scientific terms used in this application have the same meaning as commonly understood by one of ordinary skill in the art to which this application belongs.

It should be noted that the terminology used herein is only for describing a specific embodiment, and is not intended to limit the exemplary embodiments according to the present application. As used herein, the singular forms are intended to include the plural forms as well, unless the context clearly indicates otherwise, and it should also be understood that when the terms "including" and/or "including" are used in this specification, they indicate the presence of features, steps, operations, devices, components, and/or combinations thereof.

As described in the Background of the Invention, the technical problem directed in this application is the too high cost of the current ZK-based magnesium alloys and rare earth-containing magnesium alloys. Therefore, the present invention proposes a method for preparing a high-strength, low-cost Mg—Zn—Sn—Mn alloy extruded profile, and the preparation method consists of a solid solution treatment at two stages to a billet, a high-temperature pre-aging to the billet, a low-temperature rapid extrusion and a low-temperature aging treatment to a profile and other processes.

During the solid solution treatment at two stages to the billet of the present invention, a low temperature solid solution temperature is 330 to 350° C., a low temperature solid solution heat preservation duration is 2-4 hours; a high temperature solid solution temperature is 400-420° C., a high temperature solid solution heat preservation duration is 8-10 hours; and the temperature is increased at a rate of 0.8 to 2° C./min; and after solid solution treatment, a water quenching is employed as cooling manner.

During the high temperature pre-aging to the billet of the present invention, the aging temperature is 320 to 340° C., aging heat preservation duration is 1 to 3 h; and the temperature is increased at a rate of 0.8 to 2° C./min; a water quenching is employed as cooling manner.

During the low temperature rapid extrusion of the present invention, the magnesium alloy is extruded into a profile using a split assembly mold during the low temperature rapid extrusion. The preheating temperature of the billet is 10 to 20° C. lower than the high-temperature pre-aging temperature, and is 300 to 330° C., the heat preservation duration is 0.5 to 1 hour, and the temperature is increased at a rate of 0.8 to 2° C./min; the temperature of the mold is equal to that of the extrusion cylinder and is 320-340° C.; the extrusion ratio is 10-40, and the extrusion speed is 1-5 mm/min. An air cooling is employed as cooling manner.

During the low temperature aging to the billet of the present invention, the aging temperature is 150 to 160° C., heat preservation duration is 16-64 h, and the temperature is increased at a rate of 0.8 to 2° C./min.

Preferably, a solid solution treatment at two stages and the high temperature pre-aging processes to the billet can be performed continuously to save the intermediate temperature reduction and the temperature increase from room temperature. The temperature can be directly reduced from a high temperature solid solution temperature to a high temperature pre-aging temperature of the billet, using oil bath or salt bath.

Preferably, a high temperature pre-aging and a low temperature rapid extrusion processes to the billet can be performed continuously to save the intermediate temperature reduction and the temperature increase from room temperature. The temperature can be directly reduced from a high temperature pre-aging temperature to the preheating temperature of the billet, and a furnace cooling is employed as cooling manner.

The Mg—Zn—Sn—Mn magnesium alloy ingot according to the present invention has a composition in weight percentage of: 5.8-6.2% of Zn, 3.0-3.5% of Sn, 0.25-0.45% of Mn, unavoidable impurities of 0.05% or less, and the balance magnesium.

Preferably, Mg—Zn—Sn—Mn magnesium alloy ingot according to the present invention has a composition in weight percentage of: 6.0% of Zn, 3.5% of Sn, 0.30% of Mn, unavoidable impurities of 0.05% or less, and the balance magnesium.

The Mg—Zn—Sn—Mn alloy extruded profile prepared by the present invention has a tensile strength of 350 MPa or more, a yield strength of 280 MPa or more, and the elongation of 12% or more.

The specific Examples are described as follows:

The mechanical performances and average grain size of the alloy of the examples of the present invention and comparative examples are shown in Table 1. The test method of mechanical performances is performed according to GB T 228.1-2010; the measurement method of average grain size is performed according to GB T 6394-2002.

Example 1

A high-strength extruded profile of Mg-6.00 wt % Zn-3.50 wt % Sn-0.30 wt % Mn alloy is prepared by a preparation method comprising: a solid solution treatment at two stages to a billet, a high-temperature pre-aging to the billet, a low-temperature rapid extrusion and a low-temperature aging treatment to a profile etc.

The process of solid solution treatment at two stages to a billet: 340° C. was kept for 4 hours; 420° C. was kept for 10 hours; and the temperature was increased at a rate of 1° C./min; and a water quench was employed after the solid solution treatment.

The process of high temperature pre-aging to the billet: 320° C. was kept for 2 hours; and the temperature was increased at a rate of 0.8° C./min; and a water quench was employed after the pre-aging finishes.

The process of low temperature rapid extrusion: the billet was preheated at a temperature of 300° C., maintained at the temperature for 1 hour, and the temperature was increased at a rate of 2° C./min; the temperature of the mold was equal to that of the extrusion cylinder, being 320° C.; the extrusion ratio was 40, and the extrusion speed was 1 mm/min. An air cooling was employed as cooling manner for the extruded profile.

The process of low temperature aging for the profile: 150° C. was kept for 64 hours; and the temperature was increased at a rate of 1° C./min.

Example 2

A high-strength extruded profile of Mg-6.20 wt % Zn-3.00 wt % Sn-0.45 wt % Mn alloy is prepared by a preparation method comprising: a solid solution treatment at two stages to a billet, a high-temperature pre-aging to the billet, a low-temperature rapid extrusion and a low-temperature aging treatment to a profile etc.

The process of solid solution treatment at two stages to a billet: 350° C. was kept for 2 hours; 400° C. was kept for 8 hours; and the temperature was increased at a rate of 0.8° C./min; and a water quench was employed after the solid solution treatment.

The process of high temperature pre-aging to the billet: 340° C. was kept for 1 hour; and the temperature was increased at a rate of 2° C./min; and the temperature was changed to and kept at 330° C. after the pre-aging finishes.

The process of low temperature rapid extrusion: the billet was preheated at a temperature of 330° C., maintained at the temperature for 1 hour; the temperature of the mold was equal to that of the extrusion cylinder, being 340° C.; the extrusion ratio was 30, and the extrusion speed was 5 mm/min. An air cooling was employed as cooling manner for the extruded profile.

The process of low temperature aging for the profile: 160° C. was kept for 16 hours; and the temperature was increased at a rate of 0.8° C./min.

Example 3

A high-strength extruded profile of Mg-5.80 wt % Zn-3.30 wt % Sn-0.25 wt % Mn alloy is prepared by a preparation method comprising: a solid solution treatment at two stages to a billet, a high-temperature pre-aging in oil bath method, a low-temperature rapid extrusion and a low-temperature aging treatment to a profile etc.

The process of solid solution treatment at two stages to a billet: 330° C. was kept for 4 hours; 420° C. was kept for 10 hours; and the temperature was increased at a rate of 2° C./min; and in an oil bath.

The process of high temperature pre-aging in an oil bath: 320° C. was kept for 2 hours; and a water quench was employed after the pre-aging finishes.

The process of low temperature rapid extrusion: the billet was preheated at a temperature of 310° C., maintained at the temperature for 0.5 hours, and the temperature was increased at a rate of 1° C./min; the temperature of the mold was equal to that of the extrusion cylinder, being 320° C.; the extrusion ratio was 10, and the extrusion speed was 5 mm/min. An air cooling was employed as cooling manner for the extruded profile.

The process of low temperature aging for the profile: 160° C. was kept for 32 hours; and the temperature was increased at a rate of 1.5° C./min.

Comparative Example 1

It is similar to Example 1 except that the alloy had a composition of: Mg-5.50 wt % Zn-2.00 wt % Sn-0.03 wt % Mn.

Comparative Example 2

It is similar to Example 1 except that the solid solution process in the preparation method is only kept at 420° C. for 10 hours.

Comparative Example 3

It is similar to Example 1 except that the preparation method does not comprise a high temperature pre-aging process.

Comparative Example 4

It is similar to Example 1 except that the extrusion process in the preparation method: the billet was preheated at a temperature of 400° C., maintained at the temperature for 0.5 hours, and the temperature was increased at a rate of 1° C./min; the temperature of the mold was equal to that of the extrusion cylinder, being 400° C.; the extrusion ratio was 10, and the extrusion speed was 1 mm/min. An air cooling was employed as cooling manner for the extruded profile.

Comparative Example 5

It is similar to Example 1 except that the preparation method does not comprise a low-temperature aging treatment to a profile.

TABLE 1

Mechanical performances and average grain size of the magnesium alloy profiles at room temperature

| | Tensile Strength (MPa) | Yield Strength (MPa) | Elongation | Average Grain Size (μm) |
|---|---|---|---|---|
| Example 1 | 358 | 284 | 13% | about 15 |
| Example 2 | 366 | 295 | 14% | about 18 |
| Example 3 | 360 | 287 | 12% | about 20 |
| Comparative example 1 | 320 | 260 | 12% | about 20 |
| Comparative example 2 | 345 | 259 | 9% | about 32 |
| Comparative example 3 | 337 | 240 | 8% | about 34 |
| Comparative example 4 | 313 | 249 | 6% | about 55 |
| Comparative example 5 | 286 | 226 | 14% | about 15 |

By comparing the Examples with Comparative examples, it can be seen that the average grain size of the Mg—Zn—Sn—Mn alloy extruded profile prepared by the present invention is significantly better than that of the Comparative example, and the mechanical performances of the examples of the present invention are also significantly better than those of the Comparative examples.

Therefore, the mechanical performances of the low-cost and high-strength Mg—Zn—Sn—Mn alloy profiles prepared by the present invention can meet the requirements for the mechanical performances of profiles in such civil fields as electric vehicle and rail transit, and can further enlarge the application range of magnesium alloys.

Finally, it should be noted that the above are only preferred examples of the present invention, and not intended to limit the present invention. Although the present invention has been described in detail with reference to the foregoing Examples, those skilled in the art still can make modifications or portion equivalent replacements to the technical solutions described in the foregoing Examples. Any modification, equivalent replacement, or improvement made within the spirit and principle of the present invention shall be included in the protection scope of the present invention. Although the above describes the specific embodiment of the present invention, it does not limit the protection scope of the present invention. Those skilled in the art should understand that based on the technical solution of the present invention, the various modifications or deformations made by those skilled in the art without any inventive labor are still within the protection scope of the present invention.

The invention claimed is:

1. A Mg—Zn—Sn—Mn alloy, consisting of the following elements in mass percent:

5.8-6.2% of Zn, 3.0-3.5% of Sn, 0.25¬0.45% of Mn, unavoidable impurities of 0.05% or less, and the balance magnesium; and the grain size of the Mg—Zn—Sn—Mn alloy is from 10 μm to 20 μm; and the Mg—Zn—Sn—Mn alloy being produced by a method comprising: a solid solution treatment at two stages to a billet, a high-temperature pre-aging to the billet, a low-temperature rapid extrusion and a low-temperature aging treatment to a profile;

wherein, the solid solution treatment at two stages comprises: a low-temperature solid solution, a high-temperature solid solution and a cooling;

the low-temperature solid solution has a temperature of 330 to 350° C., and a low-temperature solid solution heat preservation duration of 2 to 4 hours; the high-temperature solid solution temperature has a temperature of 400-420° C., and a high-temperature solid solution heat preservation duration of 8-10 hours; and the temperature is increased at a rate of 0.8-2° C./min;

the high-temperature pre-aging has a temperature of 320-340° C.; the low-temperature rapid extrusion treatment has a mold temperature and a extrusion cylinder temperature both of 320-340° C.; and the low temperature aging is performed at conditions of: the aging temperature being 150-160° C., the heat preservation duration being 16-64 hours, and the temperature being increased at a rate of 0.8-2° C./min.

2. The Mg—Zn—Sn—Mn alloy according to claim 1, wherein the high-temperature pre-aging treatment to the billet is performed at conditions of: the aging temperature being 320-340° C., and the aging heat preservation duration being 1-3 hours; and the temperature being increased at a rate of 0.8-2° C./min.

3. The Mg—Zn—Sn—Mn alloy according to claim 1, wherein the magnesium alloy is extruded into a profile using a split assembly mold during the low temperature rapid extrusion.

4. The Mg—Zn—Sn—Mn alloy according to claim 1, wherein in the low-temperature rapid extrusion process, the preheating temperature of the billet is 10 to 20° C. lower than the high-temperature pre-aging temperature, and is 300 to 330° C., the heat preservation duration is 0.5 to 1 hour, and the temperature is increased at a rate of 0.8 to 2° C./min; the temperature of the mold is equal to that of the extrusion cylinder and is 320-340° C.; the extrusion ratio is 10-40, and the extrusion speed is 1-5 mm/min.

* * * * *